US009221226B2

(12) United States Patent
Hoover et al.

(10) Patent No.: US 9,221,226 B2
(45) Date of Patent: Dec. 29, 2015

(54) PERSONALIZED PACKAGING PRODUCTION SYSTEM

(75) Inventors: Linn C. Hoover, Webster, NY (US); William J. Nowak, Webster, NY (US); Robert A. Clark, Williamson, NY (US); Peter J. Knausdorf, Henrietta, NY (US); Thomas J. Wyble, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 917 days.

(21) Appl. No.: 13/442,268

(22) Filed: Apr. 9, 2012

(65) Prior Publication Data

US 2013/0267397 A1 Oct. 10, 2013

(51) Int. Cl.

| | |
|---|---|
| ***B31B 1/25*** | (2006.01) |
| ***B31B 1/14*** | (2006.01) |
| ***B31F 7/00*** | (2006.01) |
| ***B31F 1/08*** | (2006.01) |
| ***B31B 1/00*** | (2006.01) |

(52) U.S. Cl.

CPC ..... *B31B 1/00* (2013.01); *B31B 2201/0282* (2013.01); *B31B 2201/147* (2013.01); *B31B 2201/25* (2013.01); *B31B 2203/066* (2013.01); *B31B 2203/082* (2013.01)

(58) Field of Classification Search

CPC .... B31B 2201/145; B31B 1/16; B31B 19/10; B31B 2219/022; B31B 1/04; B31B 1/20; B65H 2404/1441

USPC ..... 493/8, 11, 13, 17–20, 22, 29, 59–61, 493/143, 144, 160, 340, 356, 360, 396

See application file for complete search history.

(56) References Cited

U.S. PATENT DOCUMENTS

| | | | | | |
|---|---|---|---|---|---|
| 3,507,489 | A * | 4/1970 | Bennett et al. | ..... | 271/182 |
| 4,759,741 | A * | 7/1988 | Chisholm, Jr. | ..... | 493/55 |
| 4,767,393 | A * | 8/1988 | Smith | ..... | 493/342 |
| 5,163,891 | A * | 11/1992 | Goldsborough et al. | ..... | 493/321 |
| 5,509,352 | A * | 4/1996 | Kowalewski et al. | ..... | 101/232 |
| 5,695,106 | A * | 12/1997 | Bauknecht | ..... | 226/2 |
| 5,768,964 | A * | 6/1998 | Meschi | ..... | 83/33 |
| 5,816,994 | A * | 10/1998 | Hill et al. | ..... | 493/324 |
| 5,840,003 | A * | 11/1998 | Meetze et al. | ..... | 493/405 |
| 5,861,078 | A * | 1/1999 | Huben et al. | ..... | 156/353 |
| 2003/0228964 | A1 * | 12/2003 | Biba | ..... | 493/81 |
| 2004/0251603 | A1 * | 12/2004 | Roth | ..... | 271/182 |
| 2005/0045005 | A1 * | 3/2005 | Hamilton et al. | ..... | 83/13 |

* cited by examiner

*Primary Examiner* — Stephen F Gerrity
*Assistant Examiner* — Eyamindae Jallow
(74) *Attorney, Agent, or Firm* — Alix, Yale & Ristas, LLP

(57) ABSTRACT

A personalized packaging production system includes an in-feed tray, an out-feed tray, a cutting table disposed intermediate the in-feed tray and the out-feed tray and an interchangeable cutting/creasing assembly. A sheet feeder is positioned between the in-feed tray and the cutting table to feed media sheets from the in-feed tray to the cutting table, and an exit nip is positioned between the out-feed tray and the cutting table to remove media sheets from the cutting table to the out-feed tray.

6 Claims, 7 Drawing Sheets

PERSONALIZED PACKAGING PRODUCTION SYSTEM

BACKGROUND

This disclosure relates generally to apparatus for converting printed products. More particularly, the present disclosure relates to apparatus for producing personalized packaging.

In one conventional method of producing personalized packaging, printing and/or images are printed on sheet media, a two-dimensional package blank is then cut from the sheet media and the package blank is then formed into a three-dimensional package. The personalized packaging market requires production volumes that range from one piece to several thousand pieces. Many low cost ($1000-$50,000) folded carton cutting solutions offered by companies such as Graphtec, Esko Artwork, Gerber, etc. rely on manually fed XY cutting tables or XΘ cutters, such as Graphtec Robo cutter, where the media is reciprocated in the process direction with nip rollers in conjunction with a cutting blade mounted on a cross process slide. While these cutters offer a low cost cutting solution, they require a dedicated operator to load media, start the cutter and unload media. This requirement for a dedicated operator is a barrier for small print shops with only 2-3 employees. While it may be possible to simply add a feeder onto an existing XY or XΘ cutter, it is expected that the throughput of such a combination will be limited to 1-2 sheets per minute.

Conventional low end cutting plotters are designed very much like the HP pen plotters that were used for generating 2D CAD drawings before the advent of wide body ink jet printing. Such plotters require that the operator perform a significant portion of the media handling, from sheet insertion to sheet removal. One additional problem with the conventional cutter plotter equipment is that the cutting pen often catches on the sheet and prevents the sheet from dropping away from the plotter.

SUMMARY

There is provided a personalized packaging production system comprising an in-feed tray, an out-feed tray, a cutting table disposed intermediate the in-feed tray and the out-feed tray and a cutting/creasing assembly. The system also comprises a sheet feeder positioned between the in-feed tray and the cutting table to feed media sheets from the in-feed tray to the cutting table, and an exit nip positioned between the out-feed tray and the cutting table to remove media sheets from the cutting table to the out-feed tray.

The personalized packaging production system may further comprise a sheet feeding mechanism consisting of a friction feed nip and a nudger roll, where the nudger roll pushes a media sheet disposed in the in-feed tray into the feed nip and the feed nip feeds the media sheet into the sheet feeder, or a vacuum based feeder consisting of articulating grippers, platens or rotating belts.

The cutting/creasing assembly may comprise a die backer roll and a cross process cutting head module including a cross process cutting head or a blade.

The cross process cutting head module may also include a control nip adapted to engage the die backer roll.

The cross process cutting head module may also include a blade guard having an opening, where the blade or cutting head is extendable through the blade guard opening to cut or crease the media sheet.

The inside diameter of the blade guard opening is larger than the outer diameter of the blade or cutting head.

The personalized packaging production system may further comprise at least one edge sensor to locate a lead edge and a trail edge of a media sheet disposed on the cutting table and at least one registration sensor and encoder to sense registration marks printed on the media sheet.

The personalized packaging production system may further comprise a controller in communication with the cutting/creasing assembly, the sheet feeder, the exit nip, the edge sensor and the registration sensor and encoder.

The cutting/creasing assembly may comprise a die backer roll and a rotary die module including a die plate.

The cross process cutting head module may also include a control nip adapted to engage the die backer roll.

A personalized packaging production system may comprise a cutting table and a cutting/creasing assembly including a die backer roll and a cross process cutting head module and a rotary die module. The cross process cutting head module is interchangeable with the rotary die module such that one of the cross process cutting head module or the rotary die module is installed in the cutting/creasing assembly when the personalized packaging production system is in operation.

BRIEF DESCRIPTION OF THE DRAWINGS

The present disclosure may be better understood and its numerous objects and advantages will become apparent to those skilled in the art by reference to the accompanying drawings in which.

DETAILED DESCRIPTION

Figure 1:
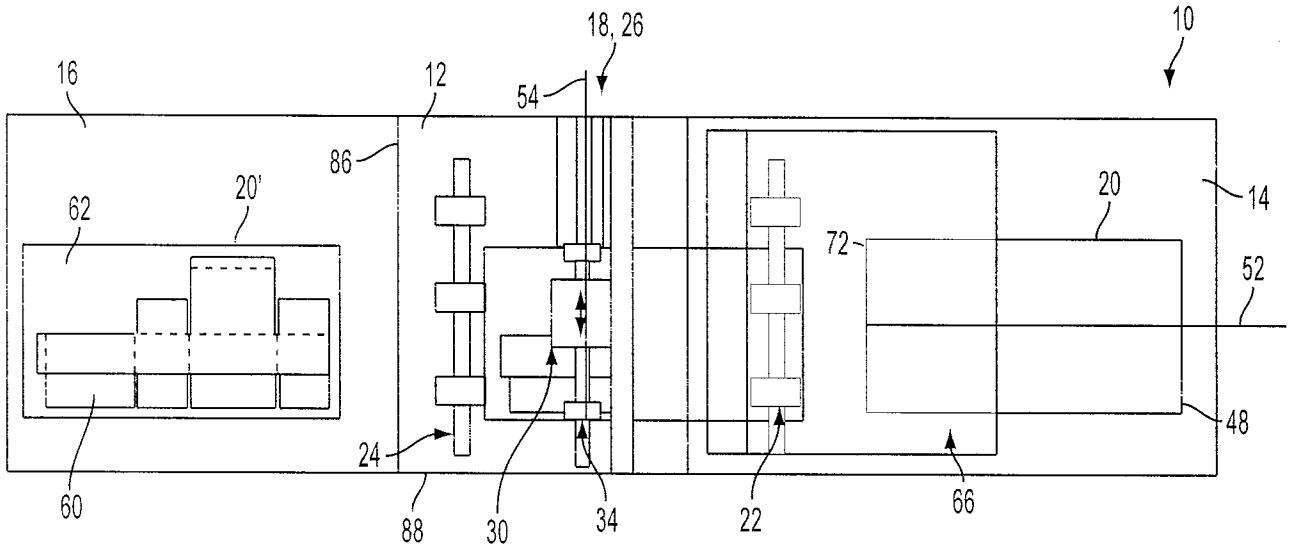
FIG. 1 is a top schematic view of a first embodiment of a personalized packaging production system in accordance with the disclosure.

With reference to the drawings wherein like numerals represent like parts throughout the several figures, a personalized packaging production system in accordance with the present disclosure is generally designated by the numeral 10, 10'.

The personalized packaging production system 10, 10' includes a cutting table 12 disposed intermediate an in-feed tray 14 and an out-feed tray 16. A cutting/creasing assembly 18 is positioned over the cutting table 12 such that a media sheet 20 positioned on the cutting table 12 may be cut and/or creased as described below. A sheet feeder 22 positioned between the in-feed tray 14 and the cutting table 12 feeds virgin media sheets 20 from the in-feed tray 14 to the cutting table 12 and an exit nip 24 positioned between the out-feed tray 16 and the cutting table 12 removes processed media sheets 20' from the cutting table 12 to the out-feed tray 16.

Figure 2:
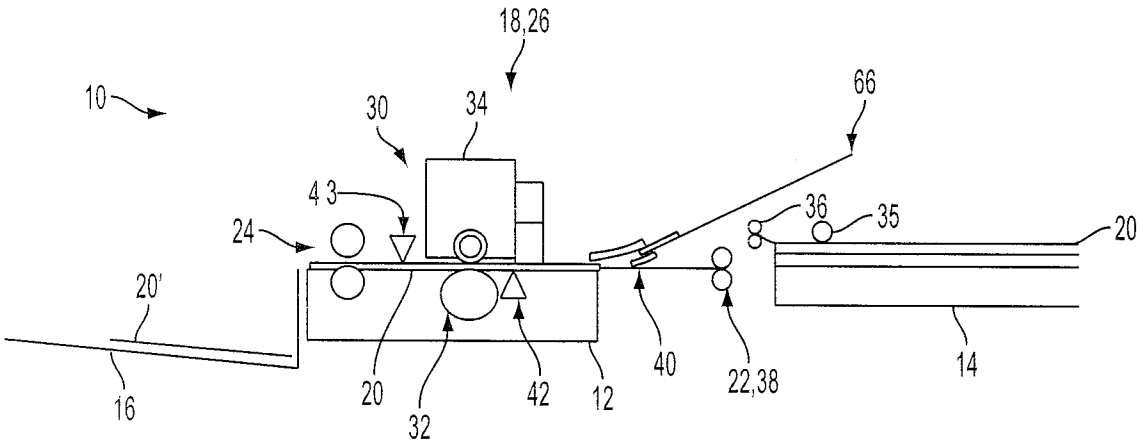
FIG. 2 is a side schematic view of the personalized packaging production system of FIG. 1.
Figure 7:
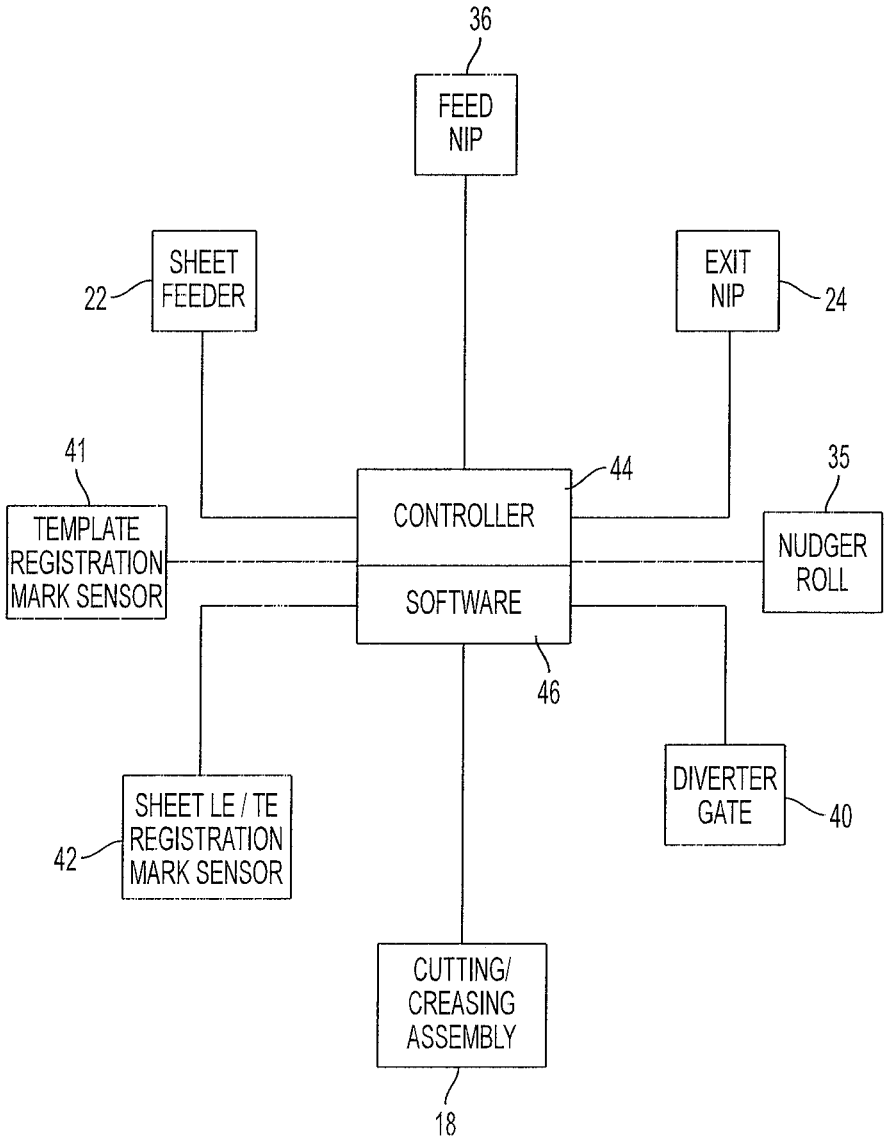
FIG. 7 is a schematic diagram of a personalized packaging production system in accordance with the disclosure.

With reference to FIGS. 1, 2 and 7, the cutting/creasing assembly 18 of a first embodiment 10 of a personalized packaging production system is a cross process/cross axis cutting head module 26. This embodiment 10 is particularly suitable for short production runs (1-200 pieces) or short lead time jobs. The cross process cutting head module 26 has a relatively slow throughput (1-2 PPM) but eliminates the lead time and cost of purchasing the rotary die module 28 of the second embodiment 10'. The cross process cutting head module 26 includes a cross process cutting head 30 installed over a die backer roll 32. An integrated control nip 34 in the cutting head module 26 engages the die backer roll 32.

The top media sheet 20 is acquired from the in-feed tray 14 by the in-feed tray nudger roll 35 which pushes the top sheet into the feed nip 36 and enters the sheet feeder take away roller (TAR) nip 38 which pulls the media sheet 20 out of the feed nip 36 of the in-feed tray 14, under a diverter gate 40 and into the control nip 34. The control nip 34 moves the media sheet 20 under the cutting head 30 to allow sensors 42 mounted on the cutting table 12 to locate the lead edge 72 and the trail edge 48 of sheet 20. Once the location of sheet 20 is established on the cutting table 12, the orientation of the sheet on the cutting table 12 is determined using registration marks (not shown) printed on the media sheet 20. Operation of the nudger roll 35, the feed nip 36, the TAR nip 22, exit nip 24, the cutting/creasing assembly 18 and the diverter 40 is controlled by a controller 44, which receives signals from the registration sensor 42, encoder located within the cutting/creasing assembly 18 and encoder mounted on the die backer roll 32. Once the controller software 46 has identified the location and orientation of the media sheet 20 through the registration marks printed on the media sheet 20, the control nip 34 translates the media sheet 20 in the X axis 52 coordinated with the cutter head Y axis 54 movement to cut and crease the package blank 60.

Registration marks on the media sheet 20 and a registration sensor 43 in the cutter head 30 measure the sheet miss registration on the cutting table 12 and adjust the cutter template to compensate for miss registered media sheets 20. The cutter head 30 then cuts 56 and scores 58 the media sheet 20 leaving semi-perforations at strategic locations, FIG. 6, around the perimeter of the package blank 60 so it remains attached to the media sheet waste 62. The exit nip 24 remains open during the cut & crease operation so it does not interfere with the control nip 34 translating the media sheet 20 in the X axis. The diverter gate 40 is actuated by the controller 44 to direct the trailing edge 48 of the media sheet 20 onto the media reverse tray 66 located above or below the sheet feeder 22.

After cutting and scoring the package blank 60, controller 44 engages the downstream exit nip 24 which pulls the media sheet 20 from the cutting table 12 and places it into the out-feed tray 16. The operator separates the cut package blank 60 from the media sheet waste 62 manually.

Figure 3:
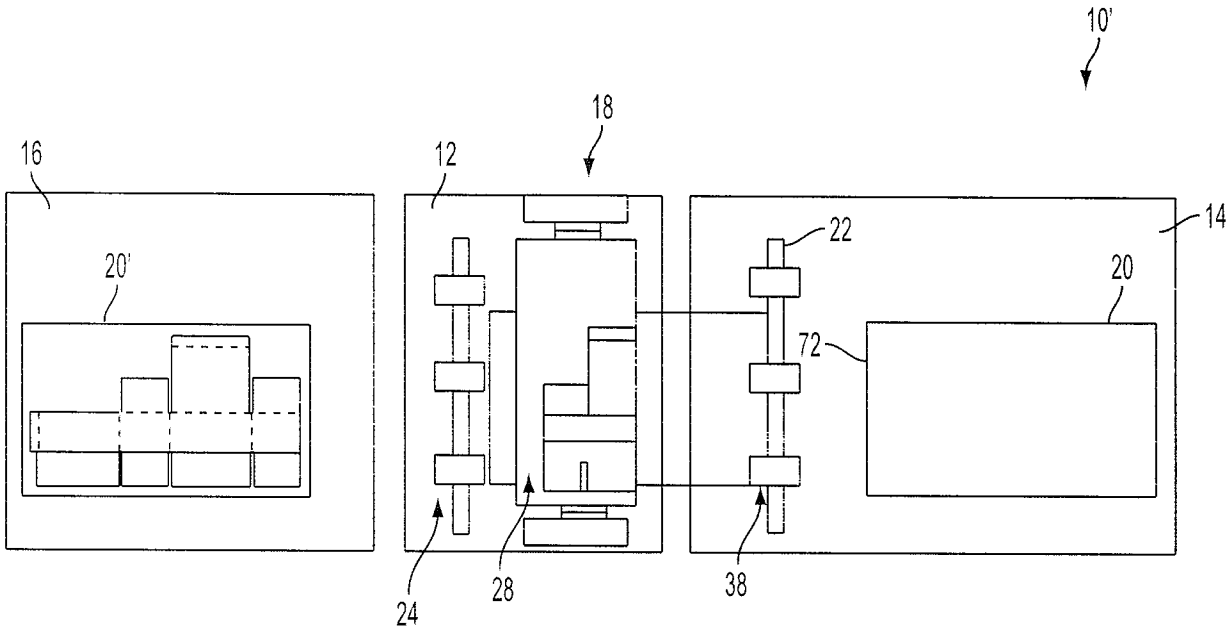
FIG. 3 is a top schematic view of a second embodiment of a personalized packaging production system in accordance with the disclosure.
Figure 4:
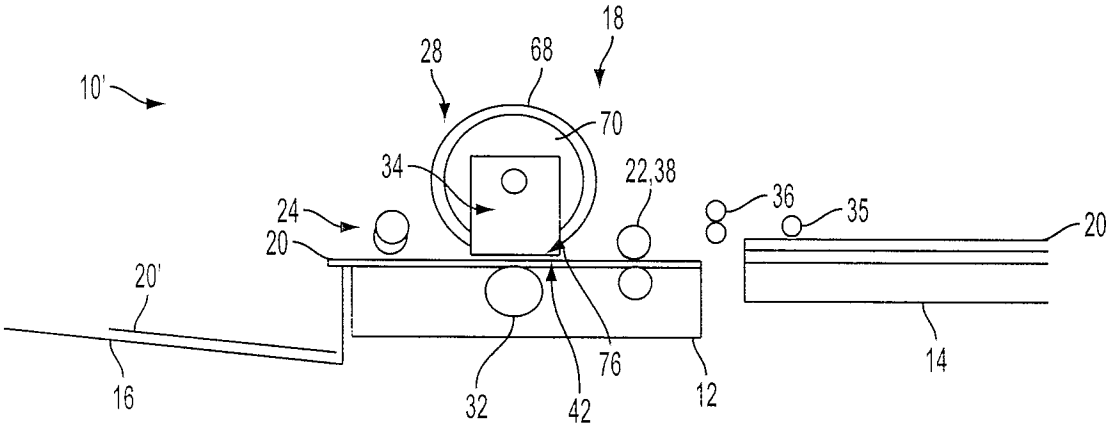
FIG. 4 is a side schematic view of the personalized packaging production system of FIG. 3.
Figure 5:
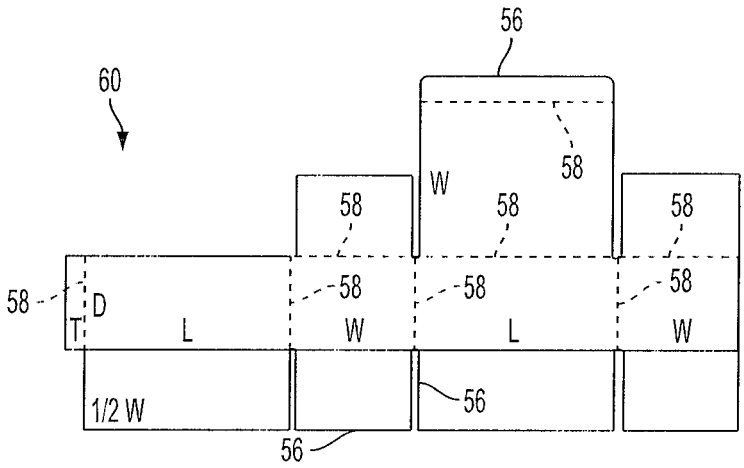
FIG. 5 is a top schematic view of a processed media sheet.

With reference to FIGS. 3 and 4, the cutting/creasing assembly 18 of the second embodiment 10' of the personalized packaging production system the cross process cutter head module 26 is replaced by a rotary die module 28. This embodiment 10' is particularly suitable for higher volume production runs (200-5000 pieces). The rotary die module 28 enables faster throughput (30-50 PPM) but requires a custom die plate 68 for each job. A 12 inch diameter drum 70 will handle up to 36 inch long media sheets 20. In this embodiment 10', the media reverse tray and diverter gate are not used. They can remain in place or removed for better access to the paper path.

The nudger roll 35 pushes the top sheet into the feed nip 36 which acquires the top media sheet 20 from the in-feed tray 14 and feeds it into the TAR nip 38, which advances the media sheet 20 until the leading edge 72 contacts a registration edge 74 on the rotary die module 28 and buckles the media sheet 20. Sensors 42 located in the cutting table 12 and the controller software 46 controls the timing between the rotary die module 28 and TAR nip 38 to adjust media buckle and registration. The rotary die module 28 requires a custom die plate 68 for each object being cut & creased. Die plates cost $200-$300 and require 15-30 minutes to setup.

It should be appreciated that the cross process/cross axis cutting head module 26 of the first embodiment 10 and the rotary die module 28 may be interchangeable since both cutting/creasing modules 26, 28 utilize the same media feed, registration, transport and exit tray features. "Interchangeable" is hereby defined to mean that either the cross process/cross axis cutting head module 26 or the rotary die module 28 may be removed from the system 10, 10' and replaced with the rotary die module 28 or the cross process/cross axis cutting head module 26, respectively, without otherwise modifying the system 10, 10'. Accordingly, the subject system 10, 10' enables both low cost variable cutting capability (XΘ) for small volumes and rotary die cutting for repetitive jobs or volumes greater 100-200 pieces.

One problem with the conventional cross process/cross axis cutting head equipment is that as the media drops into the exit tray, the trail edge flips upward and catches on the cutting pen, preventing the sheet from dropping away from the plotter. In a variation of the first embodiment of the subject personalized packaging production system 10, the cross process/cross axis cutting module 26 includes a blade guard 80 that prevents contact between the blade 82 and the media sheet 20 when the blade 82 is not deployed for cutting. Preventing contact between the blade 82 and the media sheet 20 when the blade 82 is not deployed for cutting provides two benefits: 1) the blade 82 cannot interfere with ejection of the media sheet 20; and 2) the blade 82 cannot be caught on the media sheet 20 and broken if the media sheet 20 is forcibly removed from the cutting table 12 by exit nip 24.

Figure 6:
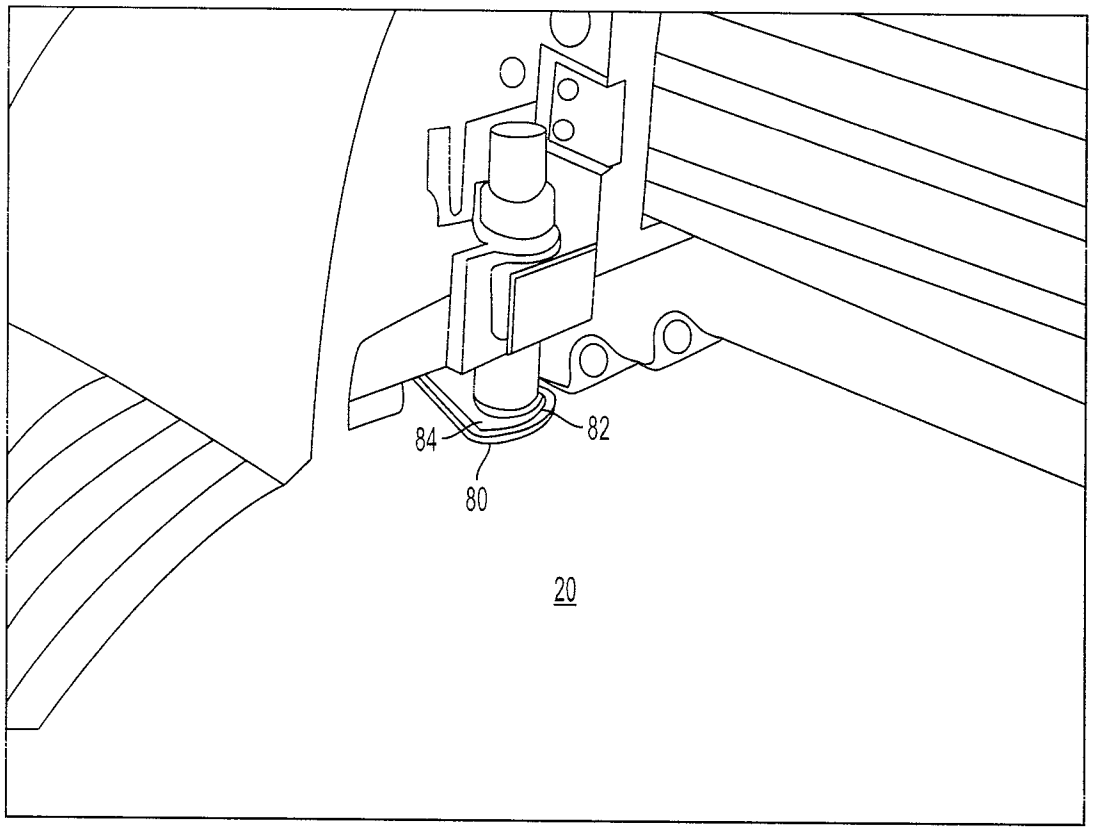
FIG. 6 is a perspective schematic view of a cross process/cross axis cutting module having a blade guard in accordance with the description.

In the example shown in FIG. 6, the blade guard 80 has the shape of a loop that surrounds the cutting head 30/blade 82. When the blade 82 is extended to cut/crease the media sheet 20 it extends through the inner opening 84 formed by the loop. When the blade 82 is retracted, the blade guard 80 is positioned between the media sheet 20 and the cutting head 30/blade 82. The inside diameter of the blade guard opening 84 is larger than the outer diameter of the cutting head 30 to ensure that there is no contact between the blade 82 and the blade guard 80.

It should be appreciated that if the out-feed tray 16 is positioned below the surface of the cutting table 12, the cross process/cross axis cutting head module 26 and rotary die module 28 are positioned sufficiently near the out-feed end 86 of the cutting table 12, and/or the out-feed end portion 88 of the cutting table 12 is sloped downward toward the out-feed tray 16, the weight of the leading portion of the media sheet 20 combined with the forward velocity provided by control nip 34 may be sufficient to eject the media sheet 20 from the cutting table 12. Under these circumstances, the use of a blade guard 80 may eliminate the requirement for an exit nip 24 to remove the media sheet 20 from the cutting table 12.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A personalized packaging production system comprises:

an in-feed tray;

an out-feed tray;

a cutting table disposed intermediate the in-feed tray and the out-feed tray;

a cutting/creasing assembly disposed above the cutting table, the cutting/creasing assembly including a die backer roll, and a cross process cutting head module having a cross process cutting head or a blade, and a blade guard defining an opening, the blade or cutting head being extendable through the blade guard opening to cut or crease the media sheet;

a sheet feeder positioned between the in-feed tray and the cutting table adapted to feed media sheets from the in-feed tray to the cutting table; and an exit nip positioned between the out-feed tray and the cutting table adapted to remove media sheets from the cutting table to the out-feed tray.

2. The personalized packaging production system of claim 1 further comprising:

a feed nip; and a nudger roll;

wherein the nudger roll is adapted to push a media sheet disposed in the in-feed tray into the feed nip and the feed nip is adapted to feed the media sheet into the sheet feeder.

3. The personalized packaging production system of claim 1 wherein the cross process cutting head module also includes a control nip adapted to engage the die backer roll.

4. The personalized packaging production system of claim 1 wherein the blade or cutting head has an outer diameter and the blade guard opening has an inside diameter, the inside diameter of the blade guard opening being larger than the outer diameter of the blade or cutting head.

5. The personalized packaging production system of claim 1 further comprising at least one edge sensor adapted to locate a lead edge and a trail edge of a media sheet disposed on the cutting table and at least one registration sensor and encoder adapted to sense registration marks printed on the media sheet.

6. The personalized packaging production system of claim 5 further comprising a controller in communication with the cutting/creasing assembly, the sheet feeder, the exit nip, the edge sensor and the registration sensor and encoder.

* * * * *